US005810294A

United States Patent [19]

Knight et al.

[11] Patent Number: 5,810,294

[45] Date of Patent: Sep. 22, 1998

[54] VANELESS ROTARY KITE

[76] Inventors: Carl E. Knight; JoAnn F. Knight, both of 2300-45 Ave., San Francisco, Calif. 94116

[21] Appl. No.: 823,127

[22] Filed: Mar. 25, 1997

[51] Int. Cl.[6] ..... B64C 31/06

[52] U.S. Cl. ..... 244/153 A; 244/155 A

[58] Field of Search ..... 244/153 R, 153 A, 244/155 R, 155 A, 154; 73/170.06, 170.05; 340/949; 446/34, 61, 66

[56] References Cited

U.S. PATENT DOCUMENTS

| | | | |
|---|---|---|---|
| 2,524,500 | 10/1950 | Whitehurst | 244/153 R |
| 2,835,462 | 5/1958 | Martin | 244/153 A |
| 2,941,765 | 6/1960 | Feldman | 244/153 R |
| 3,954,236 | 5/1976 | Brown | 244/155 R |
| 4,078,745 | 3/1978 | Knight et al. | 244/153 A |
| 4,624,648 | 11/1986 | Waters | 244/153 A |
| 5,529,266 | 6/1996 | Knight et al. | 244/153 R |

*Primary Examiner*—Galen L. Barefoot

[57] ABSTRACT

A vaneless rotary kite suitable for rotation in a direction perpendicular to the wind flow is provided with a symmetrical wind receiving surface supported by a frame and open at the ends thereof permitting the passage of air currents therethrough with a flexible baffle at the air outlet to control air flow and with at least two air vents to facilitate rotation. This vaneless rotary kite can be maneuvered during rotative flight.

5 Claims, 5 Drawing Sheets

FIG. 5
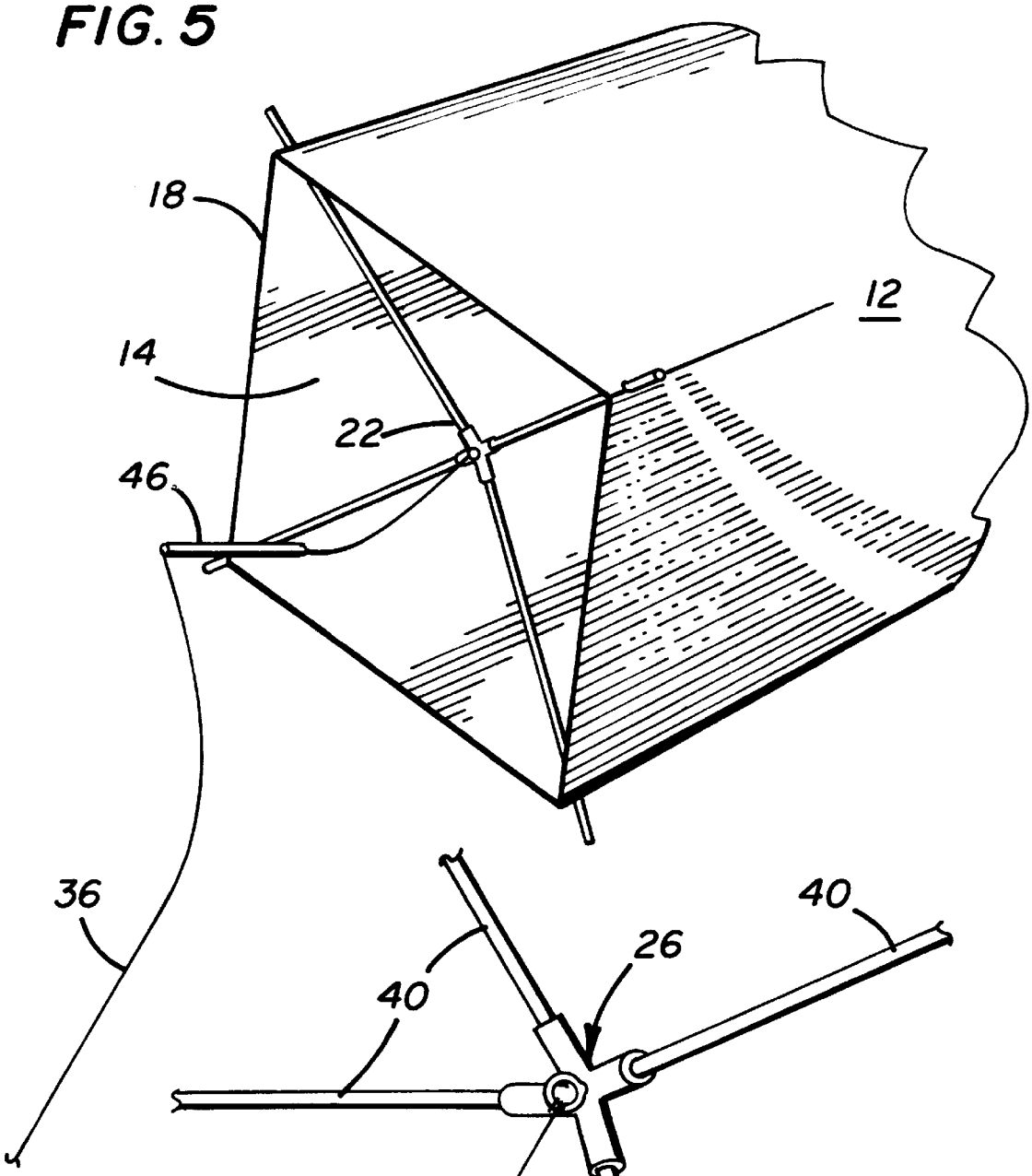
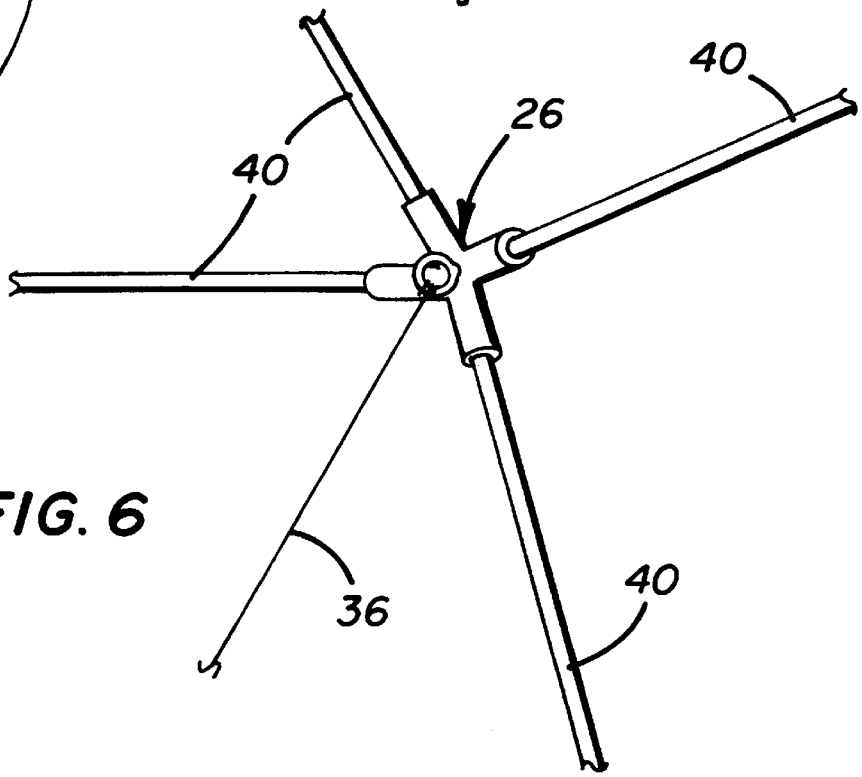
FIG. 6

VANELESS ROTARY KITE

BACKGROUND OF THE INVENTION

1. Field of the Invention

The present invention relates generally to rotary kites, and more particularly, to a vaneless rotary kite that is capable of performing aerial maneuvers such as diving.

2. Description of Related Art

The history of rotary kites that rotate perpendicular to the wind reveals that all previous designs rely on vanes that are set at an angel to wind flow for rotation. These designs include U.S. Pat. No. 2,835,462 and our own U.S. Pat. No. 4,078,745, U.S. Pat. No. 5,529,266 and our patent application Ser. No. 08-667,432 filed Jun. 21, 1996 and currently pending.

This history reveals that the fullest potential for utilizing the natural forces acting upon this type of kite to gain lift and rotation have not been realized. Although our U.S. Pat. No. 5,529,266 and U.S. patent Pending application Ser. No. 08-667,432 with a kite length to width ration of two to one, air vents, flexible air outlet, and vanes, encircling the air outlet are steps in the direction of a vaneless rotary kite they still must employ vanes for rotation.

One problem with vanes on previous art forms is that they can be deformed or broken. Another problem is that the string joining the vanes together can become snagged or tangled.

Our present invention eliminates any problem with vanes by eliminating vanes.

OBJECTS OF THE INVENTION

It is the primary object of this invention to provide a vaneless rotary kite.

It is a secondary object of this invention to provide a maneuverable vaneless rotary kite.

SUMMARY OF THE INVENTION

A rotary kite rotates in a direction perpendicular to the wind flow. Air currents passing through the kite strike a casing that baffles air flow at the air outlet. This baffling of air flow generates a vortex that is utilized to rotate the kite by means of air vents that are cut into the wind receiving surface along side the longitudinal frame means. The frame design allows the kite to be maneuvered in rotative flight.

BRIEF DESCRIPTION OF THE DRAWINGS

FIG. 5 is a cutaway perspective view showing the leading edge frame means, line means and line rod.

FIG. 6 is a perspective view of the leading edge frame means showing radial rods and yoke.

DESCRIPTION OF THE PREFERRED EMBODIMENT

Figure 1:
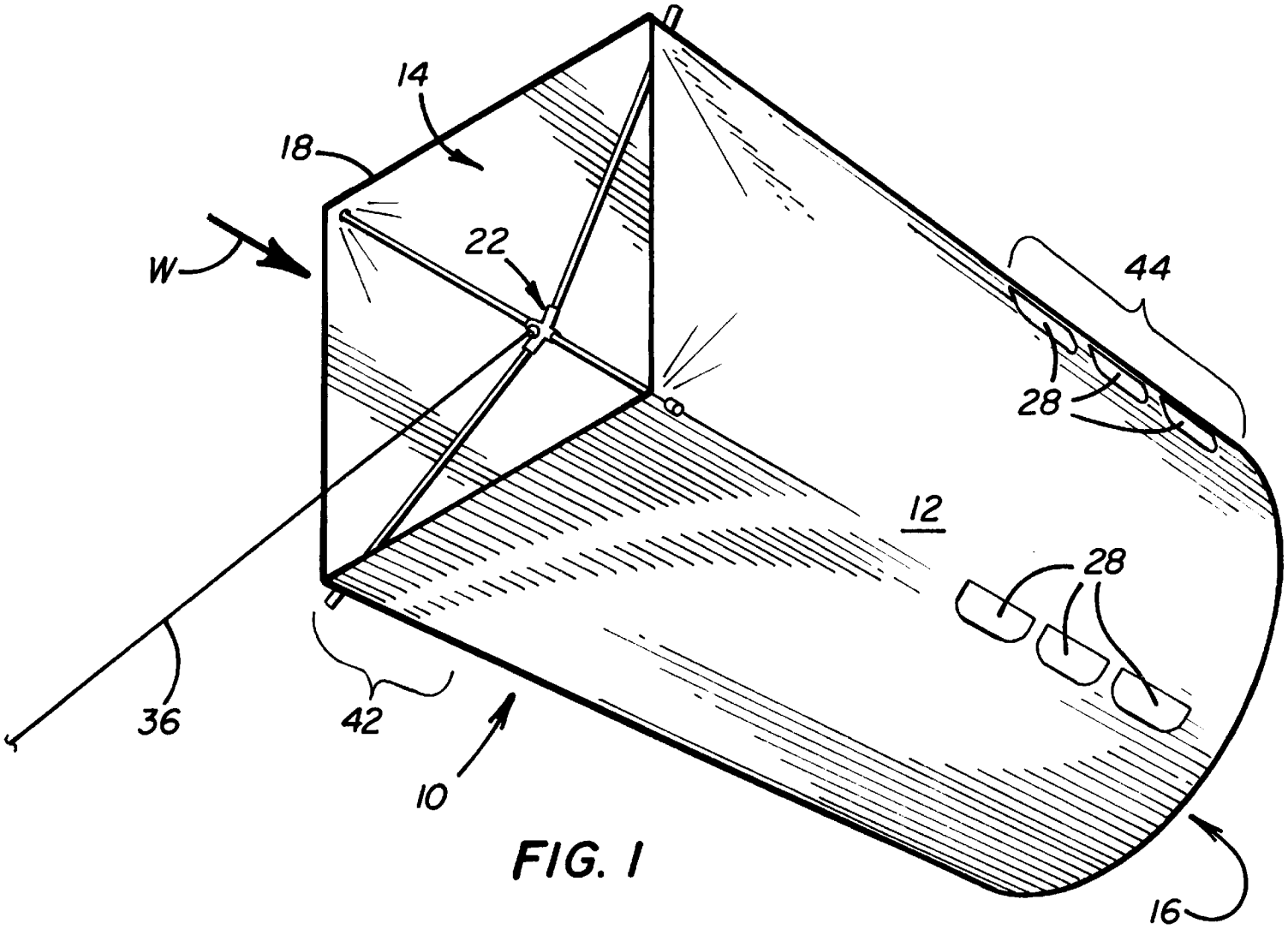
FIG. 1 is a perspective, elevational view of the rotary kite.
Figure 3:
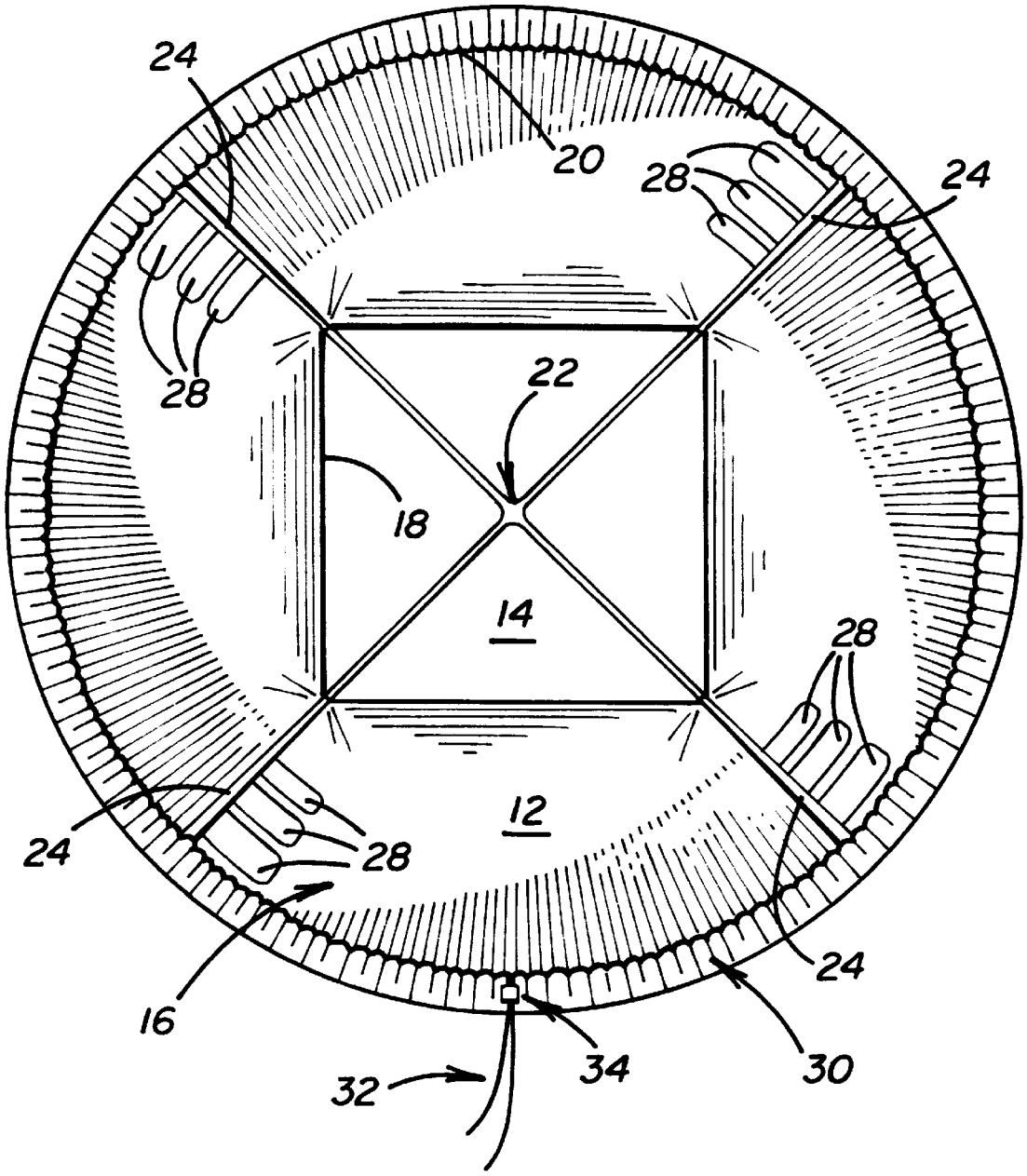
FIG. 3 is a perspective view looking through the kite from the air outlet to the air inlet.

Referring to FIGS. 1, and 3, which illustrate the rotary kite of the present invention, the rotary kite generally indicated 10 has a wind receiving surface 12 symmetrical about a central axis and open at the air inlet 14 and the air outlet 16 to permit the passage of air currents therethrough and supported by a leading edge frame means 22 and longitudinal frame means 24 and having a casing baffle 30 at the air outlet 16 to baffle air flow and having air vents 28 alongside the longitudinal frame means 24 to allow air to pass through the wind receiving surface 12 which creates a pressure differential that causes the kite 10 to rotate.

The wind receiving surface 12 can be of any known material such as paper, plastic, cloth, etc.

Figure 2:
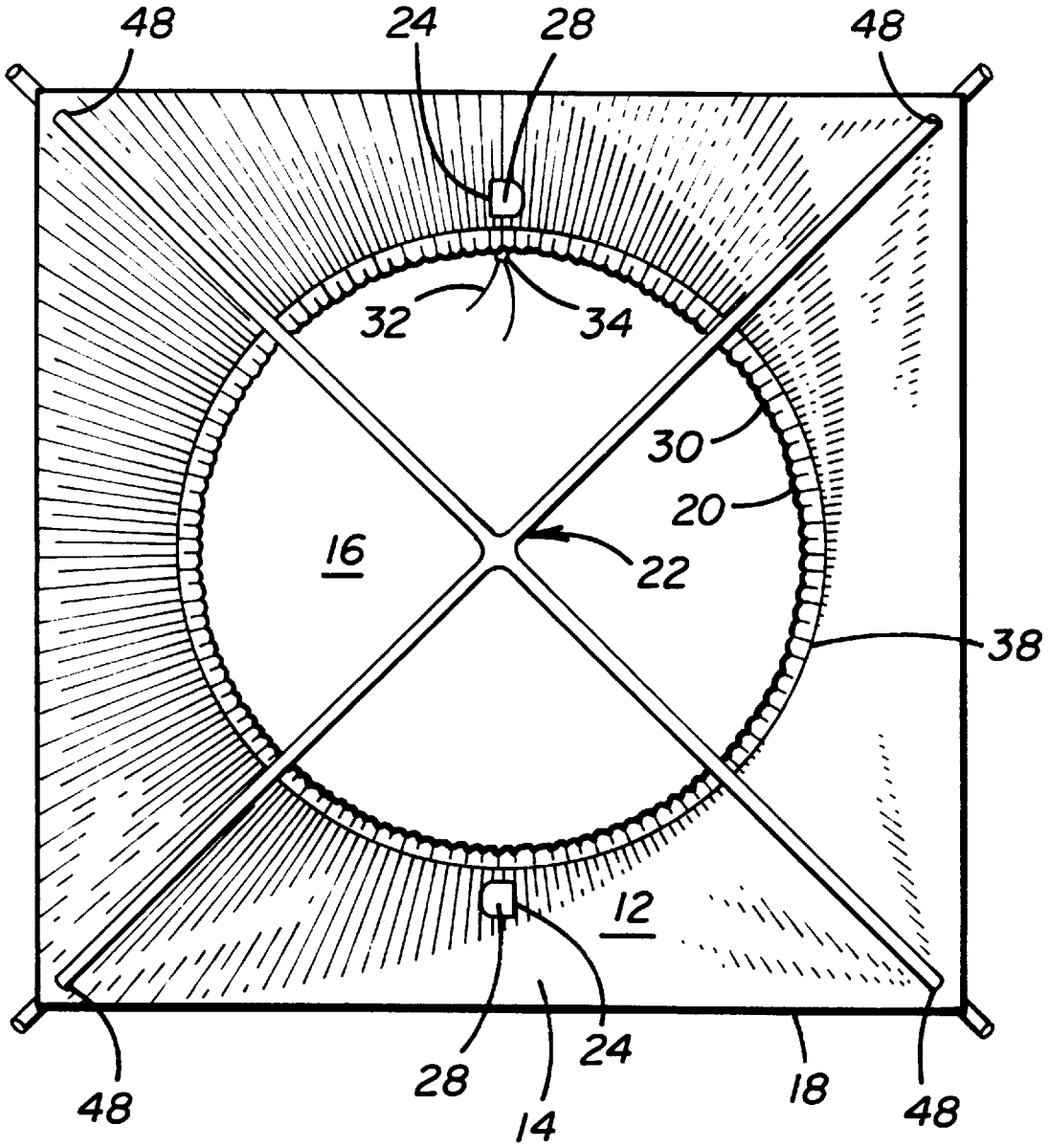
FIG. 2 is a perspective view looking through the kite from the air inlet to the air outlet.

The leading edge frame means 22 radiates from the axis of kite 10 with four or more projections that extend to the leading edge 18 to support kite 10 at the air inlet 14 as illustrated in FIGS. 1, 2, 3 and 5. Line means 36 is attached at the axis of the leading edge frame means 22 for maintaining control of kite 10 during rotative flight as illustrated in FIG. 1.; the arrow marked w indicates wind flow. The leading edge frame means 22 can be attached to the wind receiving surface 12 at the leading edge 18 by any suitable means such as by passing through holes 48 in the wind receiving surface 12 as illustrated in FIG. 2 and being secured by any suitable means such as by taping, glueing, securing with plastic tubing, etc.

The leading edge frame means 22 can be made from a single piece of plastic, fiberglass, etc., or it can be made by using a yoke 26 and radial frame means 40 as illustrated in FIG. 6. The yoke 26 can be made from two or more pieces of plastic tubing joined together at a common axis by an eye screw or eye bolt. The radial frame means 40 can be made of wood, plastic, fiberglass etc. The axis of the leading edge frame means 22 can be recessed into the kite 10 for a distance of up to 15% of the length of the kite 10 as illustrated in FIG. 1 by distance 42 to increase the lift for the kite 10.

There are two or more longitudinal frame means 24 as illustrated in FIGS. 2 and 3. The longitudinal frame means 24 can be made of any suitable lightweight material such as wood, fiberglass, plastic, etc. The longitudinal frame means 24 can extend between the leading edge 18 and the casing baffle base 38 as illustrated in FIG. 3.

Figure 4:
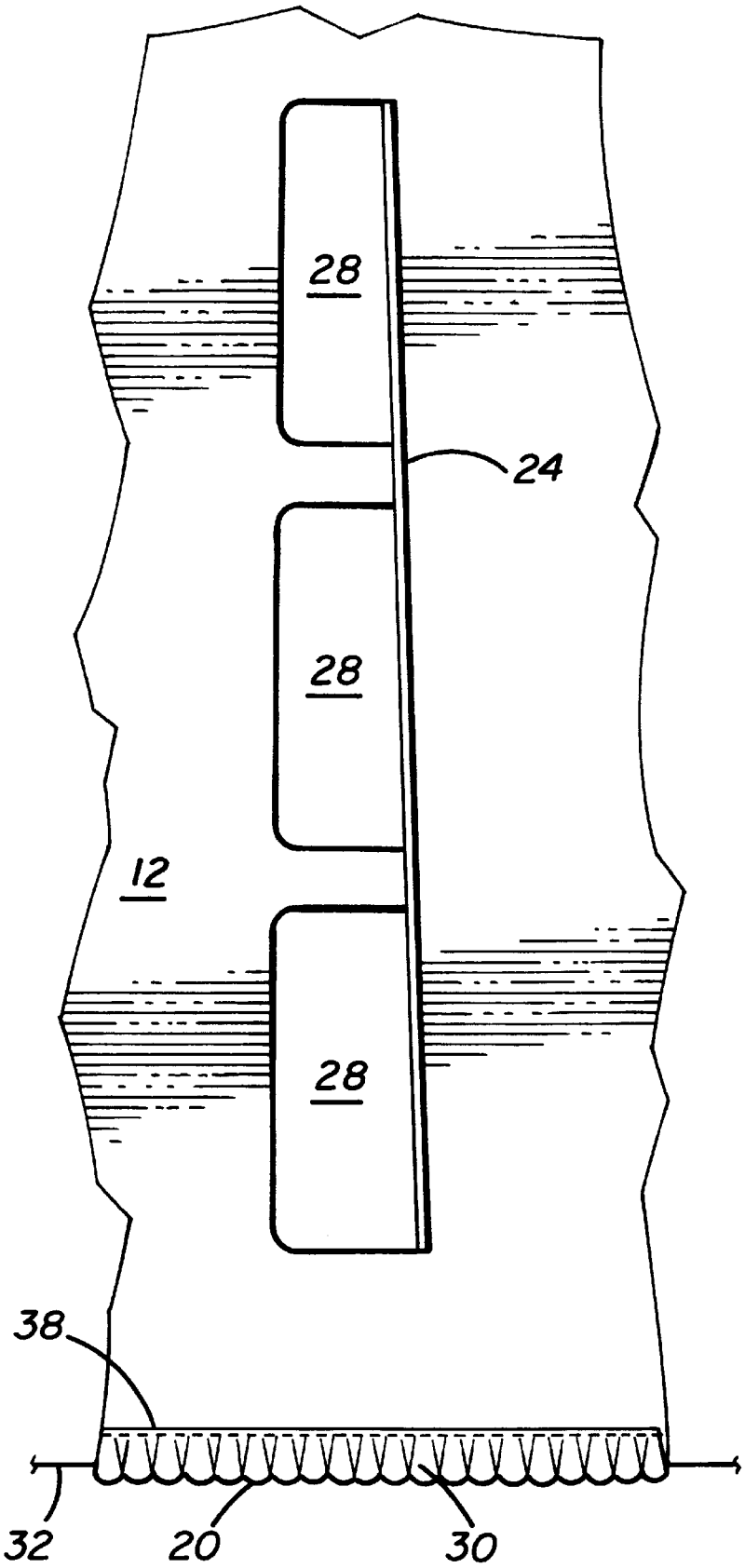
FIG. 4 is a cutaway view showing one of the longitudinal frame means and air vents.

The longitudinal frame means 24 must extend along the same side of the air vents 28 as illustrated in FIGS. 2 and 4. The longitudinal frame means 24 can be attached to the wind receiving surface 12 at any place between the leading edge 18 and the casing baffle base 38 by any suitable means such as sewing, taping, glueing, etc. The longitudinal frame means 24 must be attached to the wind receiving surface 12 along the same edge of each air vent 28. The longitudinal frame means 24 can extend to the leading edge frame means 18 as illustrated in FIG.3. The longitudinal frame means 24 can be attached to the leading edge frame means 18 by any suitable means such as by means of plastic tubing, joiners, taping, etc.

The casing baffle 30 can be made by encasing a draw string 32 in a fold of the same material that forms the wind receiving surface 12 as illustrated in FIGS. 2 and 3. The edge of this fold can be attached to the wind receiving surface 12 by any suitable means such as by glueing, taping, sewing, etc. so that the draw string 32 is completely encased in the casing baffle 30 except for the ends of the draw string 32 as illustrated in FIGS. 2 and 3. The ends of the draw string 32 are then pulled in opposite directions so that the circumference of the trailing edge 20 is less than that of the casing baffle base 38 as illustrated in FIG. 2. The circumference of the casing baffle base 38 is the same as the circumference of the wind receiving surface 12. The draw string 32 can then be secured by tying or by means of lock 34 as illustrated in FIG. 3. Lock 32 can be a piece of plastic tubing through which the draw string 32 passes. The circumference of the trailing edge 20 can be set above or below a mean of approximately 80% of the circumference of the casing baffle base 38.

The casing baffle 30 causes the air to swirl and increases pressure inside the kite 10. Air passing through the air vents 28 causes a pressure differential between the air vents 28 the wind receiving surface 12. The higher pressure on the wind receiving surface 12 will then cause the wind receiving surface 12 to move in the direction of the lower pressure of the air vents 28 in the direction of the longitudinal frame means 24 and the air vents 28 in that order to thus cause the kite 10 to rotate.

The air vents 28 can be effectively located anywhere on the wind receiving surface 12 between the center of the kite 10 and the casing baffle base 38 as illustrated by distance 44 in FIG. 1. An effective arraignment for the air vents 28 is a uniform evenly spaced arraignment as illustrated in FIGS. 1 and 3. The air vents 28 can be any effective shape. One effective uniform shape for each air vent 28 is oblong with an approximate 5 degree taper from the direction of the casing baffle base 38 to the center of the kite 10 as illustrated in FIGS. 1 and 3. The air vents 28 can be any effective size. An effective size is approximately six inches long and one to three inches wide with the vents wider toward the casing base 38 as illustrated in FIGS. 1 and 3. The total effective area of the air vents 28 is above or below a mean of approximately 20% of the area of the wind receiving surface 12 between the center of the kite 10 and the casing baffle base 38 as illustrated by distance 44 in FIG. 1.

Kite 10 can be maneuvered in rotative flight by quickly slackening the line means 36 which causes line rod 46 to come in contact with any one of the leading edge frame means 22 as illustrated in FIG. 5. As the kite 10 continues to rotate the leading edge frame means 22 will become offset and alter the kite's position in rotative flight.

It will be obvious that numerous modifications and variations are possible for the above described maneuverable, vaneless rotary kite within the scope of the present invention. The foregoing description, as setting forth various constructional and operational details for purposes of understanding only, is not to be taken as limiting the scope of the present invention which is defined by the following claims.

We claim:

1. A vaneless rotary kite suitable for flight and rotation in a direction perpendicular to wind flow comprising:

a symmetrical wind receiving surface having a leading edge and a trailing edge and open at the ends thereof to permit the passage of air currents therethrough;

frame means at the leading edge of the wind receiving surface;

line means connected to the axis of said frame means to maintain control of said kite during rotative flight;

a flexible baffle at said trailing edge of said kite to control wind flow through said kite: and air vents in said wind receiving surface with longitudinal frame means attached to said wind receiving surface along one side of said air vents to cause said kite to rotate.

2. The rotary kite of claim 1 wherein the length of the wind receiving surface is approximately twice the diameter of the wind receiving surface.

3. The rotary kite of claim 1 wherein the longitudinal frame means are connected to the leading edge frame means at the leading edge of said kite.

4. The rotary kite of claim 1 wherein the longitudinal frame means are connected to the wind receiving surface at the base of the casing baffle of said kite.

5. The rotary kite of claim 1 wherein a rod is connected to the line means of said kite wherein said rod can be manipulated to come in contact with one of the ends of the radial frame means at the leading edge of said kite in order to offset the balance of said radial frame means to maneuver said kite.

* * * * *